US006248663B1

(12) United States Patent
Bixler et al.

(10) Patent No.: US 6,248,663 B1
(45) Date of Patent: Jun. 19, 2001

(54) ELECTRICAL DATA DISTRIBUTION SYSTEM

(75) Inventors: Randall L. Bixler, LaGrange; Robert Einhaus, Fort Wayne; Rick Nowels, Kendallville; Donald E. DeWitt, Syracuse; Walter T. Kochanski, Fort Wayne, all of IN (US)

(73) Assignee: Pent Products, Inc., Kendallville, IN (US)

( * ) Notice: Subject to any disclaimer, the term of this patent is extended or adjusted under 35 U.S.C. 154(b) by 0 days.

(21) Appl. No.: 09/311,484

(22) Filed: May 13, 1999

(51) Int. Cl.[7] ..... H01R 25/00; H01R 27/02; H01R 31/00; H01R 33/88; H01R 33/90

(52) U.S. Cl. ..... 438/638

(58) Field of Search ..... 439/638, 676, 439/539, 76.1, 535

(56) References Cited

U.S. PATENT DOCUMENTS 4,103,985 * 8/1978 Krolak et al. ..... 439/367
4,303,296 * 12/1981 Spaulding ..... 439/189
4,545,632 * 10/1985 Maier et al. ..... 439/43
4,641,900 * 2/1987 Japngie ..... 439/76.1
5,038,050 * 8/1991 Minoura ..... 307/10.1
5,643,015 * 7/1997 Wakata ..... 439/701
5,697,193 * 12/1997 Forslund, III et al. ..... 52/220.5

* cited by examiner

*Primary Examiner*—Brian Sircus
*Assistant Examiner*—Brian S. Webb
(74) *Attorney, Agent, or Firm*—Taylor & Aust, P.C.

(57) ABSTRACT

An electrical data distribution system includes a housing with two end surfaces and at least six low profile side surfaces. The two end surfaces have an absence of connector cut-outs, and each of the side surfaces has at least one connector cut-out. At least one multi-pin electrical feed connector is disposed within a corresponding one of the cut-outs in a corresponding one of the side surfaces. Each feed connector is configured for connection with a multi-conductor data feed cable. A plurality of multi-pin electrical break-out connectors are associated with a plurality of the side surfaces. Each pin in each break-out connector is electrically connected with one of the pins in a corresponding feed connector. Each break-out connector is disposed within a corresponding one of the cut-outs. The break-out connectors are disposed on different side surfaces than each feed connector. Each break-out connectors is configured for connection with a workstation.

19 Claims, 3 Drawing Sheets

ELECTRICAL DATA DISTRIBUTION SYSTEM

BACKGROUND OF THE INVENTION

1. Field of the Invention

The present invention relates to electrical distribution systems, and, more particularly, to electrical data distribution systems.

2. Description of the Related Art

An electrical data distribution system typically transports data in a bidirectional manner to and from a workstation in an office environment. The data may be in the form of voice data conducted over telephone lines, or maybe computer-related data conducted over a modem, local area network (LAN), or wide area network (WAN).

Typically, each workstation in an office environment includes one or more receptacles, with each receptacle having one or more electrical connectors which are each associated with multiple-conductors for transporting the data to and from the workstation. The electrical connectors may be in the form of modular-style connectors such as RJ-45 connectors which allow peripheral equipment such as phones, computers, modems, etc. to be easily connected into the data distribution system.

A problem with a data distribution system as described above is that the connectors at each workstation must be individually hardwired back to a common data distribution location, such as a punch down connector block in a wiring closet. Whenever a workstation is moved or reconfigured, a qualified service technician must disconnect the wiring to the electrical connectors at the affected workstations before the changes can be made. The workstations can then be reconfigured as desired. After the workstations are reconfigured, the service technician must again rewire the electrical connectors in the workstation to the wiring closet. This process is expensive and time consuming.

It is also known to provide a distribution box located in the ceiling space of an office which is wired to the punch down block in the wiring closet. A plurality of breakout connectors in the distribution box allow each workstation to be quickly and easily reconfigured by simply unplugging the electrical cable between the distribution box and the workstation. Such an electrical data distribution system is a step forward over other presently used systems on the market, and is marketed under the name "Versa Cable" (TM).

When used above a ceiling in an office, the electrical distribution system described immediately above is quick, easy and relatively inexpensive to install and reconfigure. Under certain geometric constraints, however, the distribution box for distributing the data to the plurality of workstations may be too large. For example, in certain office environments having a raised floor, it may be desirable to place a distribution box in the floor rather than the ceiling. The space under the raised floor may have a height of only about 1⅛ inch. Moreover, it may also be desirable to place a distribution box within a modular wall panel in an office furniture system. Such wall panels may only have a thickness of 2–3 inches. In such applications with tight geometric space requirements, the size of known distribution boxes may be too large.

What is needed in the art is an electrical data distribution system with a distribution box which fits within small geometric constraints and still allows for high breakout capacity to a number of workstations.

SUMMARY OF THE INVENTION

The present invention provides a data distribution system with a low profile distribution box having a plurality of feed connectors and break-out connectors.

The invention comprises, in one form thereof, an electrical data distribution system including a housing with two end surfaces and at least six low profile side surfaces. The two end surfaces have an absence of connector cut-outs, and each of the side surfaces has at least one connector cut-out. At least one multi-pin electrical feed connector is disposed within a corresponding one of the cut-outs in a corresponding one of the side surfaces. Each feed connector is configured for connection with a multi-conductor data feed cable. A plurality of multi-pin electrical break-out connectors are associated with a plurality of the side surfaces. Each pin in each break-out connector is electrically connected with one of the pins in a corresponding feed connector. Each break-out connector is disposed within a corresponding one of the cut-outs. The break-out connectors are disposed on different side surfaces than each feed connector. Each break-out connectors is configured for connection with a workstation.

An advantage of the present invention is that the distribution box can fit into spaces with small geometric constraints, while still providing a high number of break-out connectors to workstations.

Another advantage is that the feed connectors and break-out connectors may be arranged in an alternating manner to avoid error during installation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
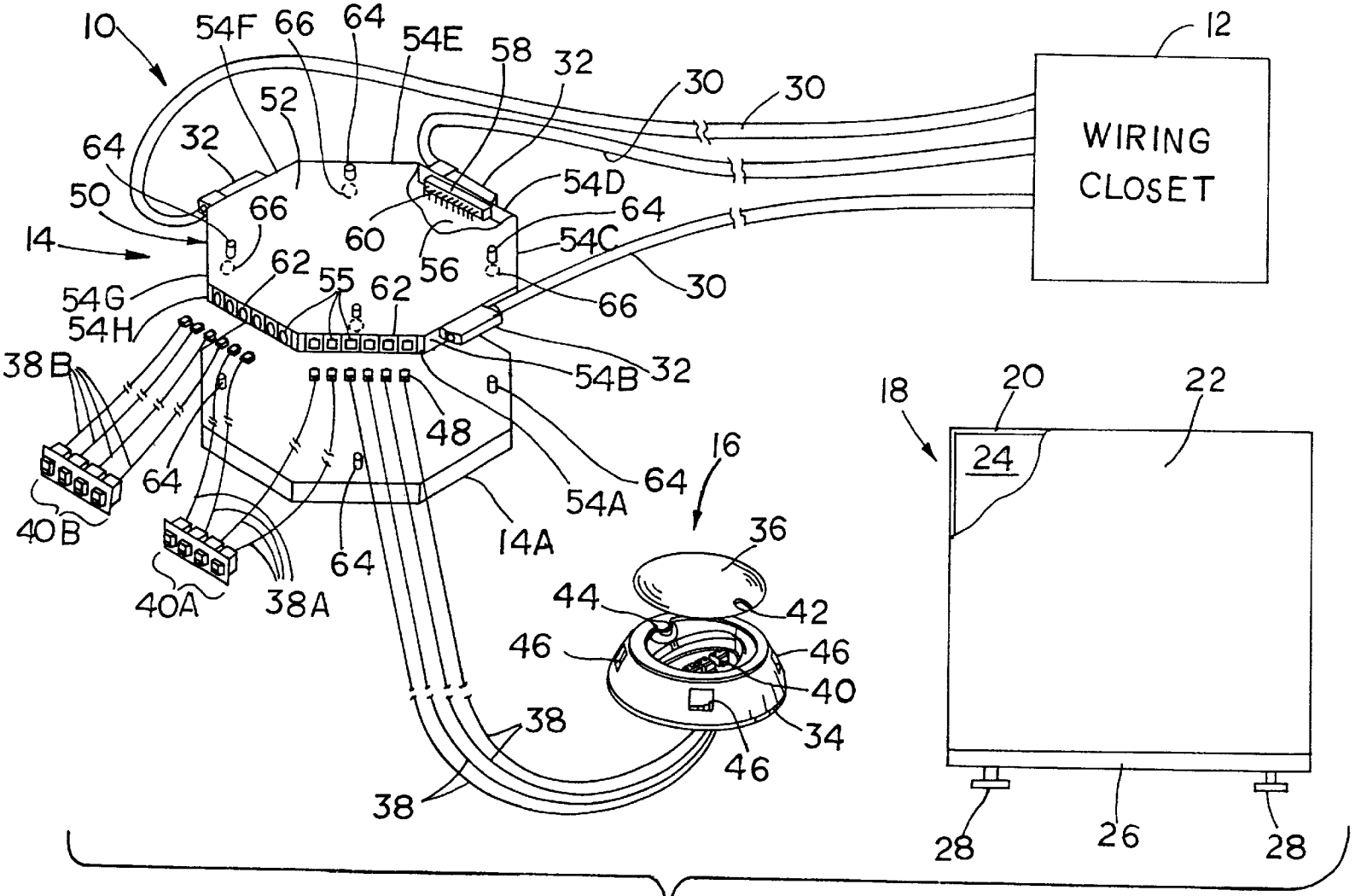
FIG. 1 is a perspective view of an embodiment of an electrical data distribution system of the present invention.
Figure 2:
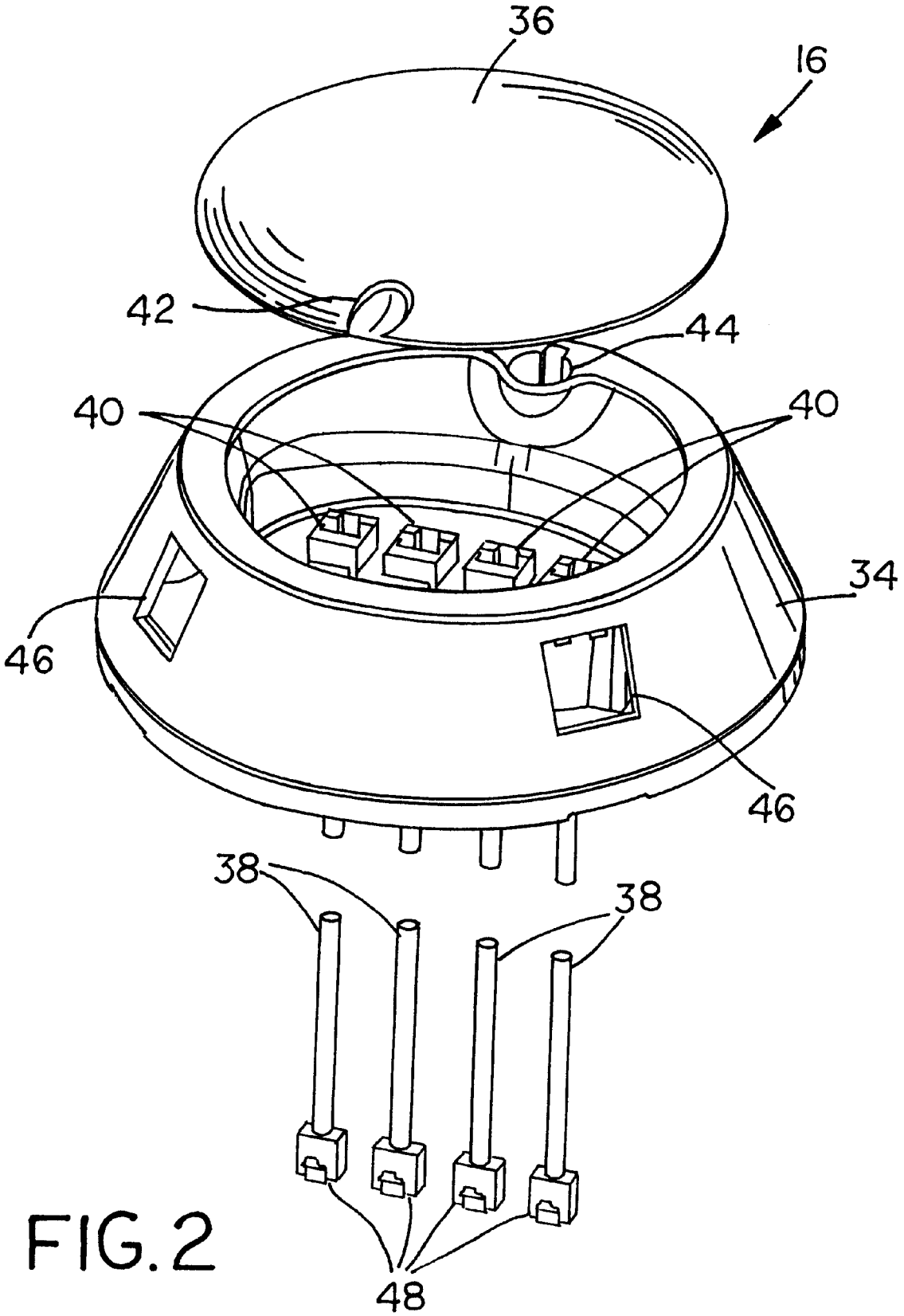
FIG. 2 is an enlarged, perspective view of the data hub shown in FIG. 1.

Referring now to the drawings, and more particularly to FIGS. 1 and 2, there is shown an embodiment of an electrical data distribution system 10 of the present invention, which generally includes a wiring closet 12, distribution box 14, data hub 16 and modular wall panel 18. Data distribution system 10 may be used within an office environment.

Wall panel 18 is of typical construction, and includes a frame 20 with side panels 22 on either side thereof. The spacing between side panels 22 in a hollow interior 24 typically is between 1.5 to 3 inches. The actual height and width of wall panel 18 may of course vary depending upon the specific application. Wall panel 18 is shown small and simplified in FIG. 1 for purposes of illustration. Wall panel 18 may also include a raceway 26 at the bottom thereof for carrying electrical components such as an electrical distribution harness, etc. Adjustable legs 28 extend from the bottom of wall panel 18.

Wiring closet 12 is used for electrically connecting with the different workstations within the office environment and distributing data to the workstations. Wiring closet 12 may include, e.g., a punch down block which electrically connects with a plurality of electrical conductors within data feed cables 30. Each data feed cable 30 includes an electrical connector 32 at an end opposite from wiring closet 12 with a plurality of pins which are respectively connected with the electrical conductors within each corresponding data feed cable 30. Electrical connectors 32, may be, e.g., fifty pin dual-row connectors.

Data distribution system 10 likely includes a plurality of data hubs 16, only one of which is shown in FIG. 1 and likewise shown in more detail in FIG. 2. Each data hub 16 includes a frustroconical shaped body 34 and a removable lid 36. A predetermined number of multi-conductor cables 38 feed into the bottom of each data hub 16 and terminate at corresponding modular connectors 40, such as RJ-45 connectors. Each connector 40 typically corresponds to a different type of data which is to be transmitted to and from data hub 16. For example, one connector 40 may correspond to telephone voice data, another connector 40 may correspond to a modem connection, and another connector 40 may correspond to a LAN connection. The peripheral equipment (not shown) at the workstation which is to be connected with connector 40 may be fed through cut-outs 42 and/or openings 44 and connected with the appropriate connector 40. Body 34 may also include a plurality of openings 46 in which may be disposed corresponding electrical receptacles (not shown) for providing electrical power to the workstation. Each workstation may have a same number of electrical connectors 40 associated therewith (such as the three different groups of four connectors 40 shown in FIG. 1). Additionally, the individual pins within each connector 40 may be respectively connected with the conductors in a corresponding multi-conductor cable 38A and 38B. Each multi-conductor cable 38, 38A, and 38B may terminate at an electrical connector, such as a modular RJ-45 connector 48.

Distribution box 14 includes a housing 50 having two end surfaces 52 and a plurality of low profile side surfaces 54A–54H. End surfaces 52 are each generally planar and disposed substantially parallel to each other. End surfaces 52 do not carry any connectors thereon, so that distribution box 14 may be utilized within an area having small geometric constraints, such as hollow interior 24 of wall panel 18.

Side surfaces 54A–54H are each associated with a particular type of electrical connector for providing data to a data hub 16. For example, side surfaces 54B, 54D and 54F are associated with data feed cables 30. On the other hand, side surfaces 54A, 54C, 54E, 54G and 54H are each associated with a plurality of break-out connectors 55 as will be described in more detail hereinafter. The use of the terms "feed" and "break-out" as used herein are not intended to mean that the data only can flow in one direction through distribution box 14. Rather, these terms are intended in a physical sense to indicate a sequential connection order relative to an origin or wiring closet 12. The data communication can of course be unidirectional or bidirectional.

To provide a number of planar side surfaces 54 which may carry corresponding connectors 32 or 55, distribution box 14 is provided with a shape which preferably has more than four side surfaces (i.e., is other than square or rectangular shaped). Distribution box 14 preferably has at least six side surfaces 54 , and in the embodiment shown has eight side surfaces 54A–54H. By providing a high number of generally planar flat surfaces 54A–54H, distribution box 14 may be connected with a relatively large number of data feed cables 30 and/or multi-conductor cables 38.

Distribution box 14 also includes a printed circuit board 56 disposed within housing 50. Printed circuit board 56 is electrically connected with a plurality of break-out connectors 55. Additionally, printed circuit board 56 is electrically connected with a plurality of multi-pin electrical feed connectors 58 associated with each electrical connector 32. In the embodiment shown, distribution box 14 includes three feed connectors 58, only one of which is shown through the fragmented portion of housing 50. Each of feed connectors 58 and break-out connectors 55 may include leads 60 which are soldered to printed circuit board 56, or may be surface mounted connectors. Printed circuit board 56 may of course include appropriate electrical traces thereon or therein which interconnect leads 60 of feed connector 58 with the leads (not shown) of break-out connectors 55.

In the embodiment shown, each of side surfaces 54A–54H includes a single cut-out 62 in which one or more feed connectors 32 or break-out connectors 55 are disposed. Of course, side surfaces 54 accommodating break-out connectors 55 may include a plurality of individual cut-outs 62, rather than a single cut-out for receiving a bank of break-out connectors 55 as shown.

Moreover, in the embodiment shown, each of side surfaces 54A, 54C, 54E, 54G and 54H accommodating break-out connectors 55 includes a cut-out 62 which maximizes the number of break-outs which can be accommodated at any one of side surfaces 54. In order to maximize the number of break-out connectors 55 on side surfaces 54, it may be necessary to associate conductors 38 corresponding to one of the workstations with more than one side surface 54. For example, in the embodiment shown, the bank of modular connectors 48 associated with a workstation include two conductors 38A associated with side surface 54A and two conductors 38A associated with side surface 54H. Although this type of configuration has the advantage of maximizing the number of break-out connectors 55 associated with side surfaces 54, it also has the potential of possibly causing an installation error because the installer must correlate different modular jacks 48 with different side surfaces 54A and 54H. To alleviate this potential error, distribution box 14 may be configured such that break-out connectors 55 on a side surface 54 are only associated with a single workstation. This alleviates the necessity for an installer to correlate break-out connectors on a side surface 54 with more than one workstation and thereby reduces installation errors.

Additionally, in the embodiment shown in FIG. 1, side surfaces 54A, 54G and 54H each are associated with break-out connectors 55. It is also possible to form side surface 54H with a cut-out which accommodates a feed connector 58 rather than break out connector 55. Configured as such, side surfaces 54A–54H would include feed connectors 58 and break-out connectors 55 in an alternating matter around the periphery thereof to further aid in the installation of data distribution system 10.

Data distribution system 10 may also include one or more additional distribution boxes, such as the schematically shown data distribution box 14A, which may be attached in an end-to-end manner to provide further capacity for the workstations within the office environment. Data distribution box 14 and additional data distribution box 14A may each include a plurality of keying projections 64 associated with one end surface 52 and a plurality of keying recesses 66 associated with an opposite end surface 52 to ensure proper orientation between data distribution boxes 14 and 14A when attached together. Other keying arrangements are also possible. Of course, depending upon the geometric constraints of the space within which distribution boxes 14, 14A are to be installed, it may not be possible to connect distribution boxes 14, 14A together in an end-to-end manner as described above.

During use, electrical data such as digital or analog data is transmitted through data feed cables 30, distribution box 14, conductors 38 and data hub 16. The data can be transferred in a bidirectional manner as appropriate. Distribution box 14 may be placed within hollow interior 24 of wall panel 18 to provide for a compact system which still has a relatively high break-out capacity. Distribution box 14 may also be installed within other areas having tight physical dimensions, such as within a raised floor in an office environment.

Figure 3:
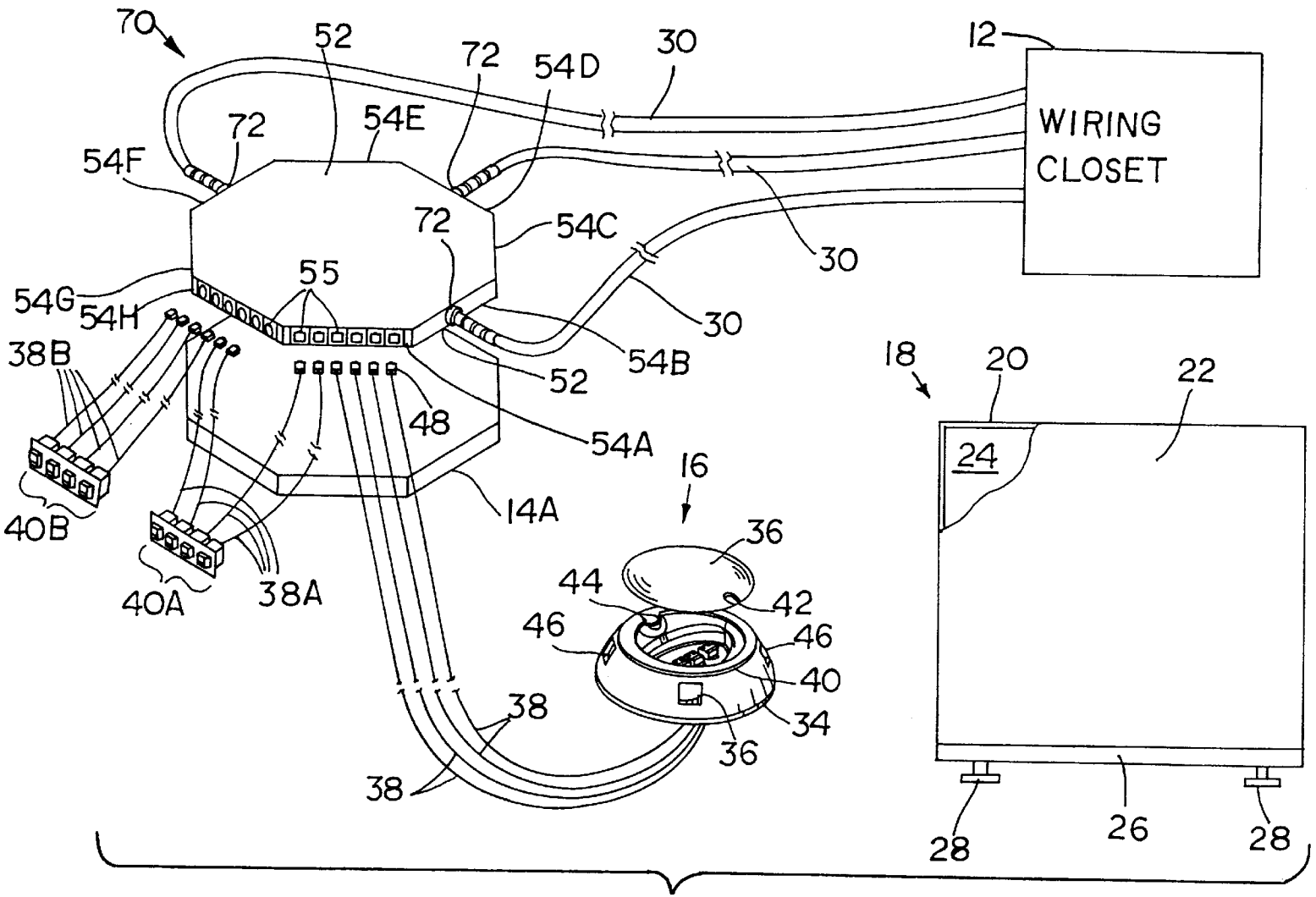
FIG. 3 is a perspective view of another embodiment of an electrical data distribution system of the present invention.

FIG. 3 illustrates another embodiment of a data distribution system 70 of the present invention which is similar to the embodiment of data distribution system 10 shown in FIGS. 1 and 2. However, data distribution system 70 does not include data feed connectors 58. Rather, each data feed cable 30 passes through a cut-out in a respective side surface 54B, 54D and 54F through a grommet 72. The individual electrical conductors of each data feed cable 30 may be connected with a printed circuit board 56 as shown in FIG. 1, or may be directly hard-wired to corresponding pin terminals within break-out connectors 55. In the embodiment shown, the individual conductors of each data feed cable 30 are hard-wired to corresponding pin terminals of break-out connectors 55.

In the embodiments described above in FIGS. 1–3, data feed cables 30 are in the form of electrical data feed cables which transmit electrical signals such as digital or analog signals over electrical conductors. However, it is also to be understood that distribution box 14 of the present invention can be used with other types of data feed cables. For example, electrical data feed cables 30 may be replaced with fiber optic feed cables which transmit data to distribution box 14. In the event that a fiber optic cable is utilized, it is necessary to use a media converter either before or within distribution box 14 to convert the fiber optic signals to electrical signals which may then be output over break-out connectors 55. In addition, data such as digital data may be transmitted to distribution box 14 via a wireless remote link such as an infrared link. With such a configuration, feed connector 58 may be in the form of a sensor which connects distribution box 14 in a wireless manner with a remote source of data. Feed connector 58 could thus be in the form of a receiver or a transceiver.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical data distribution system, comprising: a distribution box;

said distribution box having a housing including two end surfaces and a plurality of low profile side surfaces, said two end surfaces having an absence of connector cut-outs, at least two of said side surfaces including at least one cut-out; and a plurality of multi-pin electrical break-out connectors, each said break-out connector having a number of pins, each said break-out connector disposed within a corresponding one of said cut-outs;

at least one multi-conductor data feed cable associated with one of said cut-outs, each said data feed cable including a plurality of conductors, each said conductor being electrically connected to one of said pins of said break-out connectors;

at least one data hub adapted for connection with said distribution box and being configured for connection with a workstation, said data hub having a body and at least one modular connector disposed within said body; and at least one multi-conductor cable connected to at least one said break-out connector and to said at least one modular connector of said data hub.

2. The electrical data distribution system of claim 1, wherein said plurality of side surfaces comprises at least six side surfaces.

3. The electrical data distribution system of claim 2, wherein said plurality of side surfaces comprises eight side surfaces.

4. The electrical data distribution system of claim 2, wherein each of said side surfaces are generally planar except for said cut-outs.

5. The electrical data distribution system of claim 1, wherein said two end surfaces are generally planar.

6. The electrical data distribution system of claim 1, wherein each said break-out connector comprises a modular-style connector.

7. The electrical data distribution system of claim 6, wherein each said break-out connector comprises an RJ-45 connector.

8. The electrical data distribution system of claim 1, further comprising at least one multi-pin electrical feed connector disposed within one said cut-out and configured for connecting with said multi-conductor data feed cable.

9. The electrical data distribution system of claim 8, wherein said at least one feed connector comprises at least two feed connectors, and wherein said at least one break-out connector comprises at least four break-out connectors with at least two break-out connectors on each associated side surface, said feed connectors and said break-out connectors being positioned in an alternating manner on adjacent said side surfaces.

10. The electrical data distribution system of claim 8, further comprising a printed circuit board within said housing, each of said feed connectors and each of said break-out connectors being connected with said printed circuit board.

11. The electrical data distribution system of claim 1, further comprising a modular wall panel with said housing therein.

12. The electrical data distribution system of claim 1, said at least one data hub being positioned at the workstation, said data hub connected to at least two of said break-out connectors.

13. The electrical data distribution system of claim 1, further comprising at least one additional housing, each of said housings being similarly configured and stackably attached to each other in an end-to-end manner.

14. The electrical data distribution system of claim 13, wherein said housing includes a keying arrangement and said additional housing includes a mating keying arrangement which conjunctively orient said housing and said additional housing relative to each other when attached together.

15. The electrical data distribution system of claim 1, wherein each said side surface has a height substantially corresponding to said break-out connectors.

16. The electrical data distribution system of claim 1, wherein said plurality of said surfaces includes at least six low profile side surfaces, each of said side surfaces including at least one connector cut-out; and said plurality of break-out connectors includes break-out connectors associated with a plurality of said side surfaces, said break-out connectors being disposed on different said side surfaces than each said feed connector, each said break-out connector being configured for connection with a workstation.

17. The electrical data distribution system of claim 16, further comprising at least three feed connectors configured for connection with said at least one multi-conductor data feed cable, each said feed connector associated with a respective said side surface, and wherein said plurality of break-out connectors comprise at least three break-out connectors, said feed connectors and said break-out connectors being positioned in an alternating manner on adjacent said side surfaces.

18. The electrical data distribution system of claim 1 wherein, a printed circuit board is disposed within said housing;

each said data feed cable includes a plurality of conductors which are each connected with said printed circuit board; and each said break-out connector is electrically connected with one of said conductors in a corresponding said feed cable through said printed circuit board.

19. The electrical data distribution system of claim 18, further comprising at least one multi-pin electrical feed connector, each said feed connector disposed within a corresponding one of said cut-outs in a corresponding one of said side surfaces, each said feed connector interconnecting said data feed cable with said printed circuit board.

* * * * *